US009752399B2

(12) United States Patent
Timmerman et al.

(10) Patent No.: US 9,752,399 B2
(45) Date of Patent: Sep. 5, 2017

(54) WELLBORE STRENGTHENING MATERIAL RECOVERY

(75) Inventors: Michael A. Timmerman, Cincinnati, OH (US); Brian S. Carr, Burlington, KY (US); James A. Marshall, Union, KY (US)

(73) Assignee: M-I L.L.C., Houston, TX (US)

( * ) Notice: Subject to any disclaimer, the term of this patent is extended or adjusted under 35 U.S.C. 154(b) by 56 days.

(21) Appl. No.: 13/201,963

(22) PCT Filed: Mar. 5, 2010

(86) PCT No.: PCT/US2010/026398
§ 371 (c)(1),
(2), (4) Date: Aug. 17, 2011

(87) PCT Pub. No.: WO2010/102232
PCT Pub. Date: Sep. 10, 2010

(65) Prior Publication Data

US 2011/0297373 A1 Dec. 8, 2011

Related U.S. Application Data

(60) Provisional application No. 61/158,217, filed on Mar. 6, 2009.

(51) Int. Cl.
*B07B 13/16* (2006.01)
*E21B 21/06* (2006.01)

(52) U.S. Cl.
CPC ..... *E21B 21/063* (2013.01); *B07B 13/16* (2013.01); *B07B 2201/04* (2013.01); *B07B 2230/01* (2013.01)

(58) Field of Classification Search
CPC . E21B 21/065; E21B 21/003; B07B 2201/04; B07B 2230/01; B01D 21/283; B01D 33/015; B01D 33/0346; B01D 33/0376; B01D 33/41; B01D 33/763; B01D 35/20; B01D 35/28
USPC ..... 209/248, 250, 311, 315, 316, 317, 319, 209/324, 326, 366.5, 367, 389, 405, 409,
(Continued)

(56) References Cited

U.S. PATENT DOCUMENTS 4,116,288 A * 9/1978 Love ..... 175/66
4,582,597 A * 4/1986 Huber ..... 209/313
5,614,094 A 3/1997 Deister et al.
(Continued)

OTHER PUBLICATIONS

Examination Report issued in corresponding Canadian Application No. 2,752,719; dated Oct. 10, 2012 (3 pages).
(Continued)

*Primary Examiner* — Bobby Ramdhanie
*Assistant Examiner* — Patrick Orme
(74) *Attorney, Agent, or Firm* — David J. Smith

(57) ABSTRACT

A wellbore strengthening material collection system including a vibratory separator having a top deck, a middle deck, and a bottom deck, and also including a collection trough coupled to at least one of the decks and configured to receive wellbore strengthening materials from the at least one of the decks. Additionally, a collection trough including a body having an inlet and an outlet, an angled surface disposed within the body and at least on extension surface extending form the body and configured to secure the collection trough to a vibratory separator.

16 Claims, 9 Drawing Sheets

(58) Field of Classification Search
USPC ..... 209/413, 204; 175/66, 206; 210/324, 210/388, 389
See application file for complete search history.

(56) References Cited

U.S. PATENT DOCUMENTS

| | | | | |
|---|---|---|---|---|
| 6,155,428 | A | 12/2000 | Bailey et al. | |
| 6,530,482 | B1 * | 3/2003 | Wiseman | 209/253 |
| 7,306,104 | B2 | 12/2007 | Zeller | |
| 7,740,761 | B2 * | 6/2010 | Bailey | 210/330 |
| 2006/0144779 | A1 | 7/2006 | Bailey | |
| 2007/0131592 | A1 * | 6/2007 | Browne et al. | 209/399 |
| 2008/0251428 | A1 | 10/2008 | Bailey | |

OTHER PUBLICATIONS

International Search Report issued in PCT/US2010/026398, dated Sep. 27, 2010, 3 pages.
Written Opinion issued in PCT/US2010/026398, dated Sep. 27, 2010, 5 pages.
Office Action issued in corresponding Chinese Application No. 201080009948.3 dated Sep. 3, 2013 (17 pages).
Official Action issued in corresponding Mexican Application No. MX/a/2011/009018 with English reporting thereof dated Jan. 30, 2013 (8 pages).
Office Action issued in Mexican Application No. MX/a/2011/009018 with English correspondence reporting the same; dated Sep. 26, 2014 (5 pages).
Official Action issued in corresponding Mexican Application No. MX/a/2011/009018 with English reporting thereof dated Jun. 30, 2014 (6 pages).
Office Action issued in corresponding Canadian Patent Application No. 2,752,719 dated Jan. 14, 2014 (3 pages).
Official Action issued in corresponding Eurasian Application No. 201171107/31 with English translation dated Mar. 7, 2014 (4 pages).
Office Action issued in corresponding Chinese Application No. 201080009948.3 with English translation dated Apr. 22, 2014 (25 pages).
Office Action issued in Mexican Application No. MX/a/2011/009018 with English correspondence reporting the same; dated Feb. 18, 2015 (7 pages).
Supplementary European Search Report issued in corresponding European Application No. 10749405.6 dated Nov. 14, 2014 (8 pages).
Official Action issued in corresponding Eurasian Application No. 201171107/31 with English reporting thereof dated Dec. 22, 2014 (4 pages).
Official Action issued in corresponding Eurasian Application No. 201171107/31; dated Aug. 24, 2015 (4 pages).
Office Action issued in corresponding Argentine Application No. 20100100685 with English reporting thereof dated Sep. 18, 2015 (10 pages).

* cited by examiner

WELLBORE STRENGTHENING MATERIAL RECOVERY

BACKGROUND

Field of the Disclosure

Embodiments disclosed herein relate generally to vibratory separator components for collecting wellbore strengthening materials. More specifically, embodiments disclosed herein relate to removable vibratory separator components for collecting wellbore strengthening materials during drilling. More specifically still, embodiments disclosed herein relate to removable vibratory separator components for collecting wellbore strengthening materials on offshore drilling operations.

Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and re-pumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. The shale shaker may be angled table with a generally perforated filter screen bottom. Returning drilling fluid is deposited at the feed end of the shale shaker. As the drilling fluid travels down length of the vibrating table, the fluid falls through the perforations to a reservoir below leaving the solid particulate material behind. The vibrating action of the shale shaker table conveys solid particles left behind until they fall off the discharge end of the shaker table. The above-described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Recently, drilling fluids containing bridging materials, also known in the art as wellbore strengthening materials or loss prevention materials, have seen increased use in drilling operations where natural fractures in the wellbore allow drilling fluid to escape from the circulating system. Wellbore strengthening materials are typically mixed into the drilling fluid and used to bridge the fractures to prevent fluid loss into the formation. Such wellbore strengthening materials are also used in stress cage drilling, which involves intentionally creating fractures in the wellbore and bridging the fractures with the materials. Such applications create a hoop stress and stabilize the formation.

Wellbore strengthening materials typically are more expensive than other additives used in drilling fluid components. Thus, drillers benefit when wellbore strengthening materials are recovered during waste remediation. However, during drilling waste remediation, which may include use of vibratory separators to remove cuttings from return drilling fluid, as the cuttings are removed, the wellbore strengthening materials are also removed. The removal of wellbore strengthening materials during drilling waste remediation requires additional wellbore strengthening materials being added to the drilling fluid, thereby increasing the cost of the drilling operation.

Accordingly, there exists a need for methods and apparatuses to recover wellbore strengthening materials during separation operations at drilling locations.

SUMMARY OF THE DISCLOSURE

In one aspect, embodiments disclosed herein relate to a wellbore strengthening material collection system including a vibratory separator having a top deck, a middle deck, and a bottom deck. The system also including a collection trough coupled to at least one of the decks and configured to receive wellbore strengthening materials from the at least one of the decks.

In another aspect, embodiments disclosed herein relate to a collection trough including a body having an inlet and an outlet, an angled surface disposed within the body, and at least one extension surface extending from the body and configured to secure the collection trough to a vibratory separator.

In another aspect, embodiments disclosed herein relate to a method of recovering wellbore strengthening materials, the method including providing a flow of drilling fluid from a wellbore to a vibratory separator, separating the drilling fluid into a first effluent and a solids portion, separating wellbore strengthening materials from the first effluent, and directing the wellbore strengthening materials to an active drilling fluid system via a removable collection trough.

Other aspects and advantages of the invention will be apparent from the following description and the appended claims.

DETAILED DESCRIPTION

In one aspect, embodiments disclosed herein relate generally to a wellbore strengthening material collection system for collecting wellbore strengthening materials. In another aspect, embodiments disclosed herein relate to removable vibratory separator components for collecting wellbore strengthening materials during drilling. In still other aspects, embodiments disclosed herein relate to removable vibratory separator components for collecting wellbore strengthening materials on offshore drilling operations.

Figure 1:
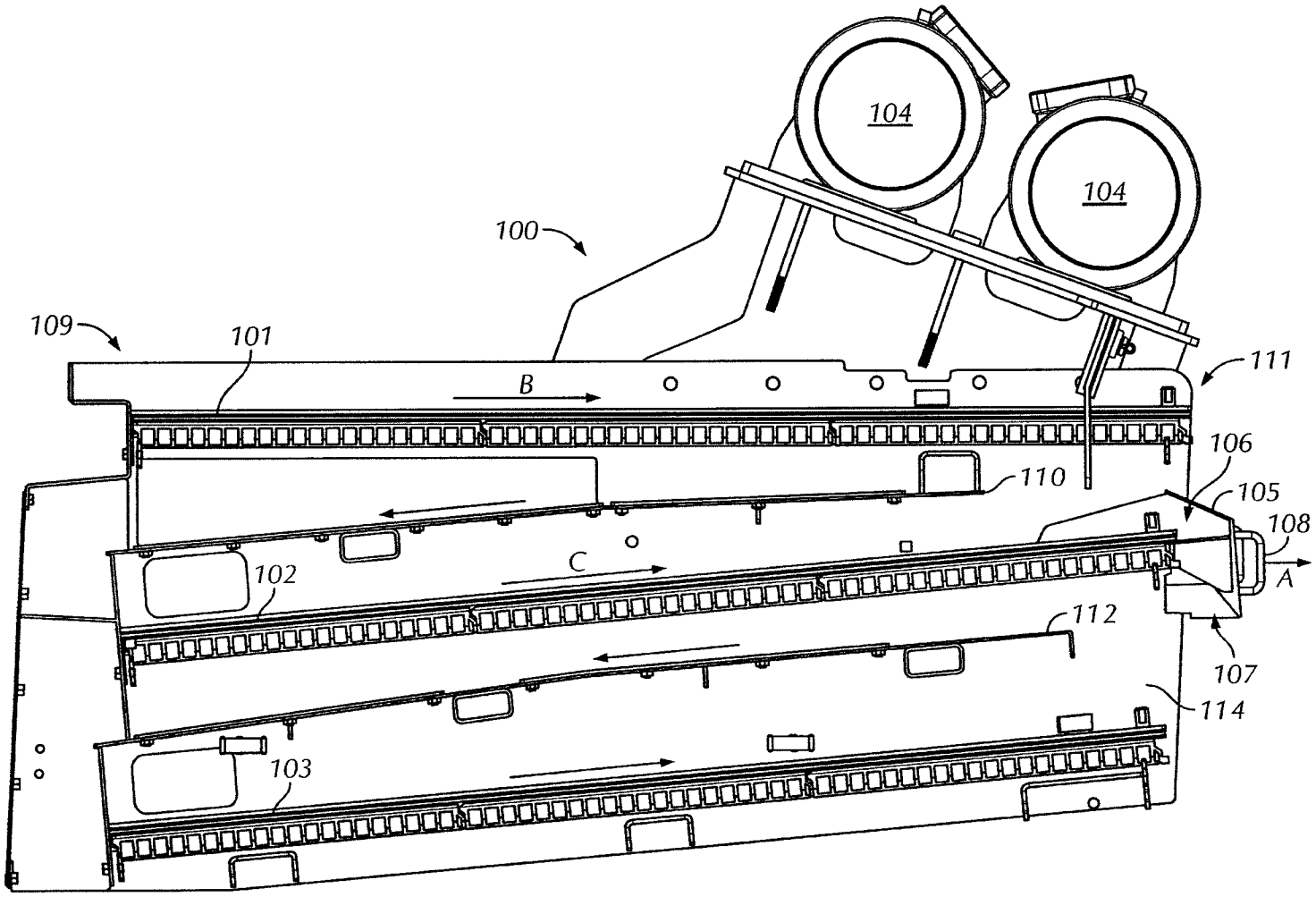
FIG. 1 is a cross-section view of a vibratory separator according to embodiments of the present disclosure.

Referring to FIG. 1, a cross-section plan view of a vibratory separator having a collection trough according to embodiments of the present disclosure is shown. In this embodiment, vibratory separator 100 includes three decks 101, 102, and 103, wherein top deck 101 is a scalping deck, middle deck 102 is a second cut deck, and bottom deck 103 is a fines deck. Vibratory separator 100 also includes two motion actuators 104 configured to provide a motion to decks 101, 102, and 103 during operation. As illustrated, a collection trough 105 is in fluid communication with middle deck 102. Collection trough may be formed from various materials, such as steel, and may include various coatings to prevent corrosion during operation.

Each deck 101, 102, and 103 may include one or more screens (not independently illustrated). The screens include a plurality of perforations of a particular size, thereby allowing fluids and solids entrained therein that are smaller than the size of the perforations to flow through the screens, while particular matter larger than the screen is retained on top of the screen for further processing. Those of ordinary skill in the art will appreciate that the screens on each of decks 101, 102, and 103 may have different perforation sizes, such that the over flow (the retained solids) from each screen are a different sizes. In such an embodiment, the retained solids from deck 101 may be of a larger size than the retained solids from decks 102 and 103. Thus, by selecting different perforation size for screens on decks 101, 102, and 103, a specific solid size from each deck may be retained. Those of ordinary skill in the art will appreciate that depending on the requirements of a separatory operation, one or more of the screens on decks 101, 102, and/or 103 may also have screens with perforations of the same or substantially the same size.

As drilling fluid containing particulate matter enters vibratory separator 100 though an inlet side 109, the particular matter flows in direction B, such that fluid and undersized particles form an underflow (i.e., fluids and particulate matter that passes through screens), pass through a screen on first deck 101 and into a first flow back pan 110. The overflow that did not pass through the screen on first deck 101 may then be discharged from first deck 101 at large particulate discharge point 111. The underflow then flows down first flowback pan 110 and onto deck 102. Fluids and particulate matter smaller than the perforations in the screen on deck 102 fall through middle deck 102 screen and onto second flowback pan 112, while wellbore strengthening materials are moved in direction C.

Vibratory separator 100 also includes a collection trough 105 coupled to at least one of the decks 101, 102, or 103 of vibratory separator 100. In this embodiment, collection trough 105 is illustrated coupled to middle deck 102. As illustrated, collection trough 105 is configured to receive a flow of solid overflow from the second deck 102, which includes solids that are too large to fit through the perforations in a screen on second deck 102. In certain aspects, the solids that are collected in collection trough 105 may include wellbore strengthening materials, such as fluid wellbore strengthening materials that are designed to lower the volume of filtrate that passes through a filter medium and into the formation. Examples of wellbore strengthening materials include sized-salts, sized-calcium carbonates, polymers, and other wellbore strengthening materials known in the art.

Collection trough 105, in this aspect, includes an inlet 106 configured to receive an overflow from the second deck 102 and an outlet 107 configured to direct the overflow to the active drilling fluid system. The active drilling fluid system may include drilling fluid tanks, mixing tanks, or other containers located at the drilling site, where drilling fluids are mixed and stored prior to use during drilling. Collection trough 105 also includes handles 108, which are configured to allow an operator to remove collection trough 105 when either wellbore strengthening materials are not being used or when collection of such lost control materials is not required. In certain aspects, it may be desirable for the separatory operation to continue without the collection of wellbore strengthening materials. In such an operation, the operator may simply remove collection trough 105 from second deck 102 by sliding collection trough 105 in direction A. In certain embodiments, collection trough 105 may be secured to second deck through mechanical attachment points, such as bolts or screws, while in other aspects, collection trough 105 may be secured to deck 102 through a pneumatic actuation system, such as pneumatic systems typically used to secure screens to decks.

Those of ordinary skill in the art will appreciate that collection trough 105 may be disposed on other decks, such as first deck 101 or third deck 103 in certain separatory operations. For example, in a return flow of drilling fluid with high solids content, it may be beneficial to collect wellbore strengthening materials from third deck 103, while in other operations, it may be beneficial to collect wellbore strengthening materials from first deck 101. In still other aspects, a collection trough may be used on more than one deck to collection multiple sized wellbore strengthening materials. Additionally, the location of collection trough 105 may be selected based on the perforation size of the screens on a particular deck or based on the size of the wellbore strengthening materials being collected.

Fluids and particulate matter that is smaller than a perforation size of a screen on deck 102 do not enter collection trough 105; rather, the fluids and fine particulate matter pass through the screen on middle deck 102 onto flow back pan 112. In a final separatory action, fluids and particulate matter smaller than a screen on deck 103 flow through the screen into a reservoir in vibratory separator 100 that is in fluid communication with the active drilling fluid system. Fines that are larger than the perforation on screens disposed on the bottom deck 103 are discharged from the vibratory separator at discharge point 114 for disposal thereafter.

In certain applications the flow through vibratory separator 100 may be modified by, for example, providing for a bypass of one or more of the decks 101, 102, and/or 103. Additionally, series and/or parallel flow may be achieved by diverting a flow of fluid around one or more of decks 101, 102, 103, or away from one or more of flow back pans 110 and/or 112.

In other embodiment, collection trough 105 may be configured to couple to more than one deck of vibratory separator 100. For example, collection trough 105 may be configured to couple to first deck 101 and second deck 102. In such an embodiment, collection trough 105 may be coupled to first deck 101, while collecting wellbore strengthening materials from second deck 102. In other embodiments, collection trough may be coupled to third deck 103, while collecting wellbore strengthening materials from second deck 102. Those of ordinary skill in the art will appreciate that other combinations of collection trough 105 mounting locations and wellbore strengthening collection locations may also be used. As such, collection trough 105 may be mounted on a deck from which wellbore strengthening materials are collected, or alternatively, may be mounted on a deck from which wellbore strengthening materials are not collected. In still other embodiments, collection trough 105 may be mounted to all of the decks of a particular vibratory separator 100.

Figure 2:
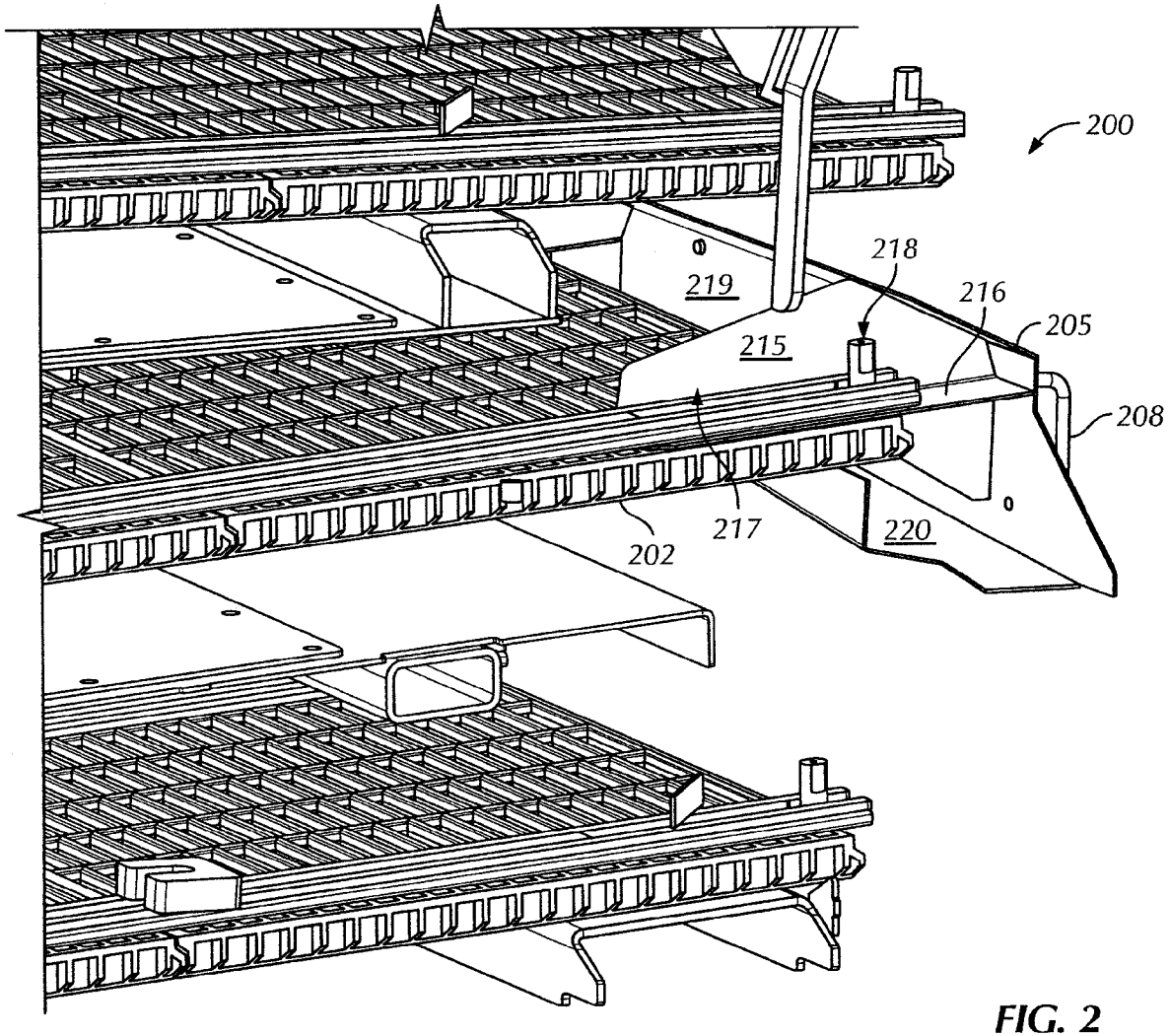
FIG. 2 is a plan view of a vibratory separator screen according to embodiments of the present disclosure.

Referring to FIG. 2, a side plan view of a collection trough 205 installed on a vibratory separator 200 according to embodiments of the present disclosure is shown. In this embodiment, collection trough 205 is illustrated disposed on a vibratory separator 200 on a middle deck 202. Collection trough also includes handles 208 and an engagement surface 215 configured to interface with a deck of the separator (middle deck 202 in this embodiment). Engagement surface 215 includes an extension panel 216 that is configured to slide along the surface of a side rail 217 of deck 202. After the extension panel 216 slides along side rail 217 into a final orientation, a mechanical attachment 218 may be used to hold the collection trough 205 in place on vibratory separator 200. In certain embodiments, mechanical attachment may not be required, and a pneumatic securing system may hold collection trough 205 in place. In still other embodiments, a slot (not illustrated) on extension panel 216 may be used to slide the collection panel 205 into engagement with deck 202 without requiring additional attachment mechanisms for securing collection trough 205 in place.

Collection trough 205 also includes a back wall 219 onto which handles 208 are secured. Additionally, collection trough 205 includes an angled lower surface 220 onto which wellbore strengthening material may fall from a deck of a vibratory separator. The angled lower surface 220 may be angled so as to allow wellbore strengthening materials to flow from collection trough 205 to the active drilling fluid system. Those of ordinary skill in the art will appreciate that the angle of angled lower surface 220 should be sufficient to allow wellbore strengthening materials to flow without the need for operator interference. However, in certain aspects, a residual volume of wellbore strengthening materials may collect in the trough during normal operation.

Figure 3:
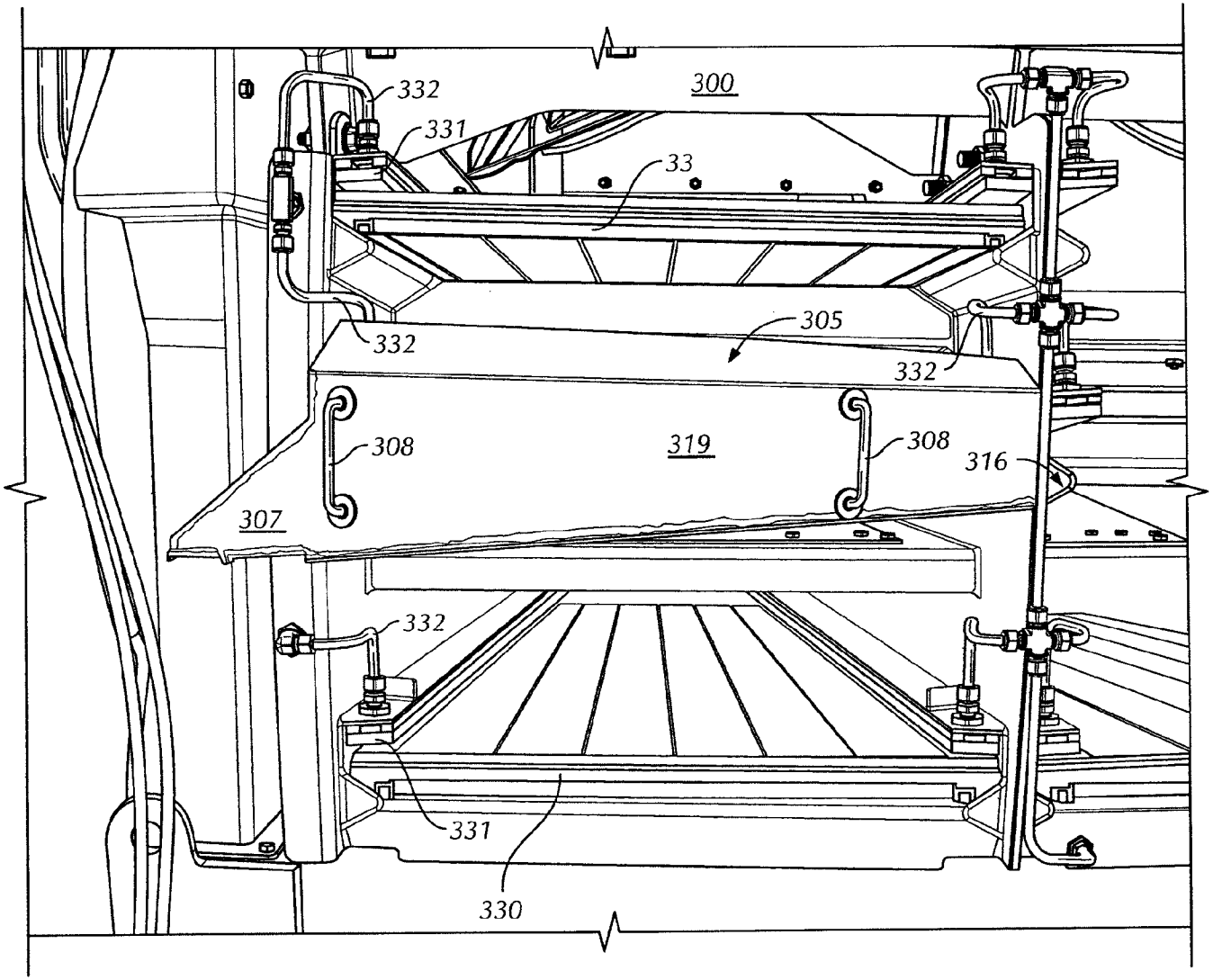
FIG. 3 is an end view of a vibratory separator screen according to embodiments of the present disclosure.
Figure 4:
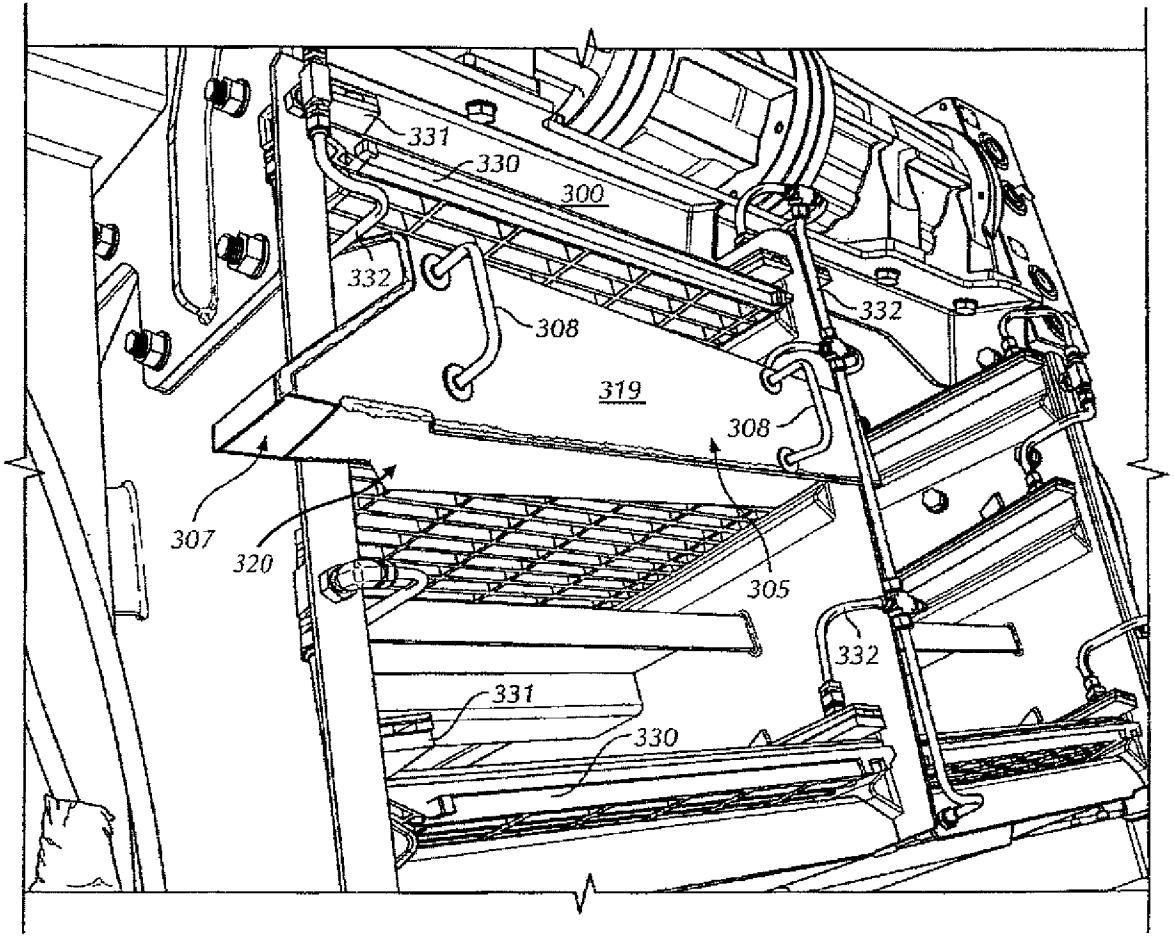
FIG. 4 is a perspective view of a vibratory separator according to embodiments of the present disclosure.

Referring to FIGS. 3 and 4 together, an end view and end perspective view of a collection trough disposed on a vibratory separator according to embodiments of the present disclosure are shown, respectively. In this embodiment, collection trough 305 includes an end wall 319 with handles 308 disposed thereon. Collection trough 305 also includes a lower angled section 320 configured to direct wellbore strengthening materials to flow through collection trough 305 and discharge through outlet 307.

To install collection trough 305 on a vibratory separator 300, extension panels 316 may slide between a screen 330 and a bottom surface of a clamping actuator 331. As pressure is supplied to clamping actuators 331 via air pressure line 332, the bottom surface of clamping actuators 331 engages the top surface of the extension panel 316 of collection 305, thereby securing the collection trough 305 to the vibratory separator 300. When an operator decides that the collection of wellbore strengthening materials is no longer required, the collection clamping actuator 331 is disengaged from extension panels 316 by decreasing the air pressure supplied through air pressure lines 332. When the clamping actuator 331 is no longer engaging the extension panels 316, collection trough 305 may be removed from vibratory separator 300 by sliding the collection trough 305 therefrom.

Those of ordinary skill in the art will appreciate that various methods of securing screens to decks of vibratory separators are known in the art. Clamping actuators 331, such as those disclosed herein are merely exemplary of different types of clamping mechanisms that may be used according to the embodiments of the present disclosure. In alternate embodiments, hydraulic, mechanical, or no independent clamping actuators may be required to secure collection trough 305 to vibratory separator 300. However, because collection trough 305 is configured to be removably engaged with vibratory separator 300, various clamping actuators 331 are within the scope of the present disclosure.

Figure 5:
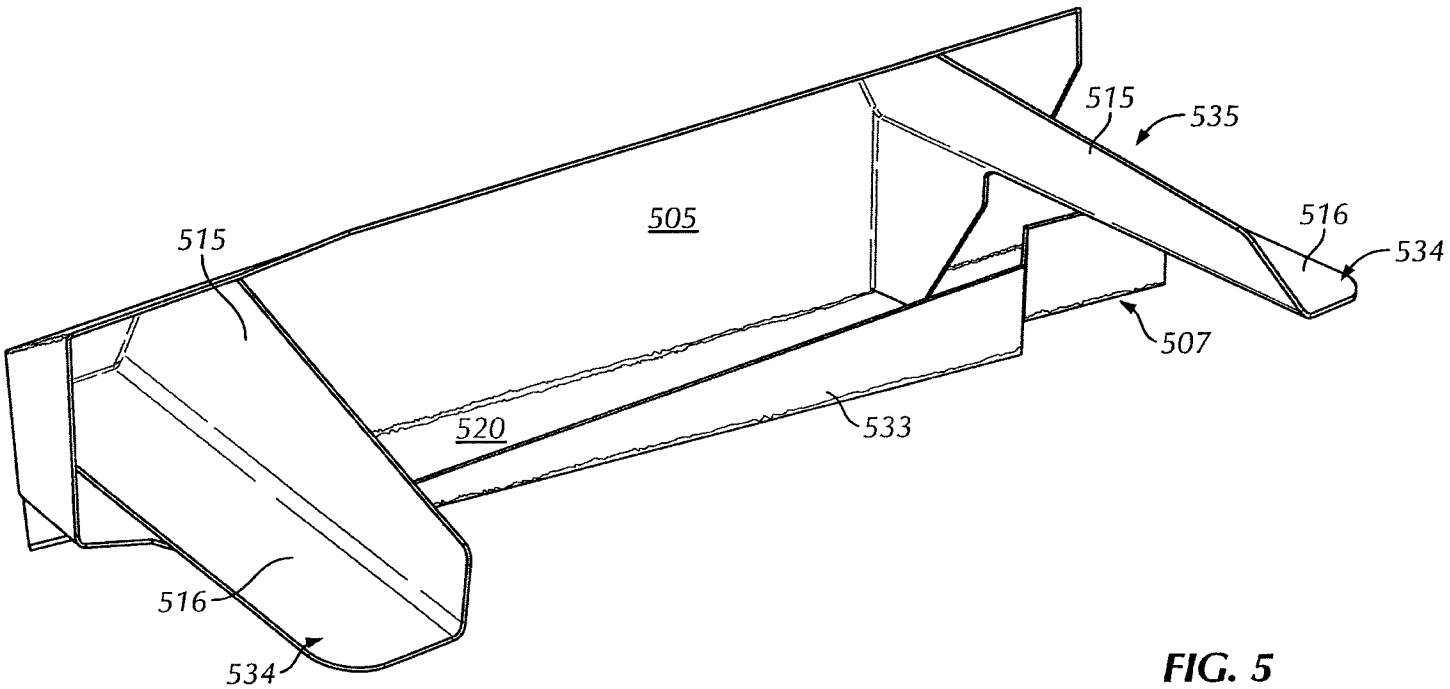
FIG. 5 is a back-side view of a vibratory separator according to embodiments of the present disclosure.
Figure 6A:
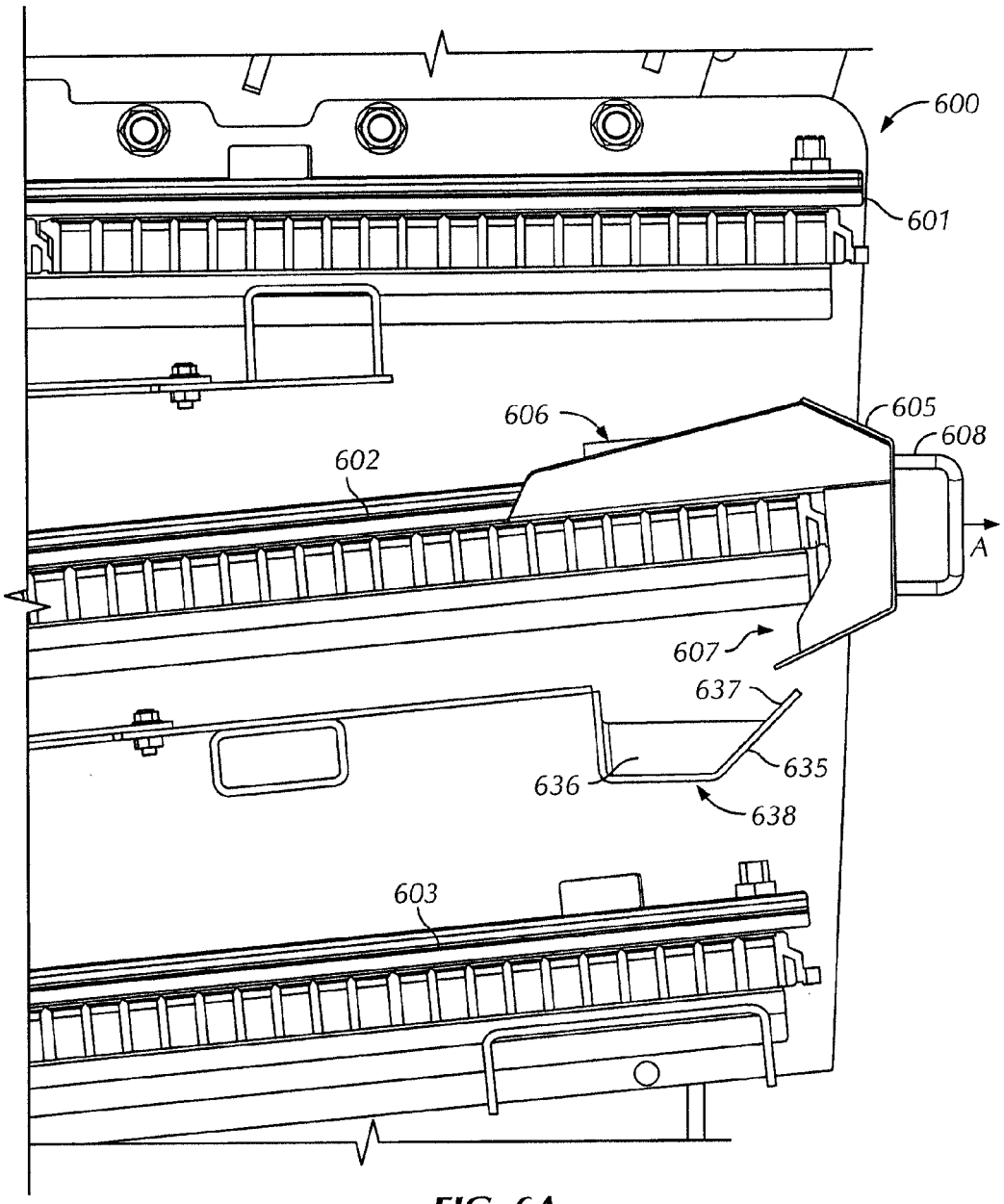
FIG. 6A is a cross-sectional side view of a vibratory separator according to embodiments of the present disclosure.
Figure 6B:
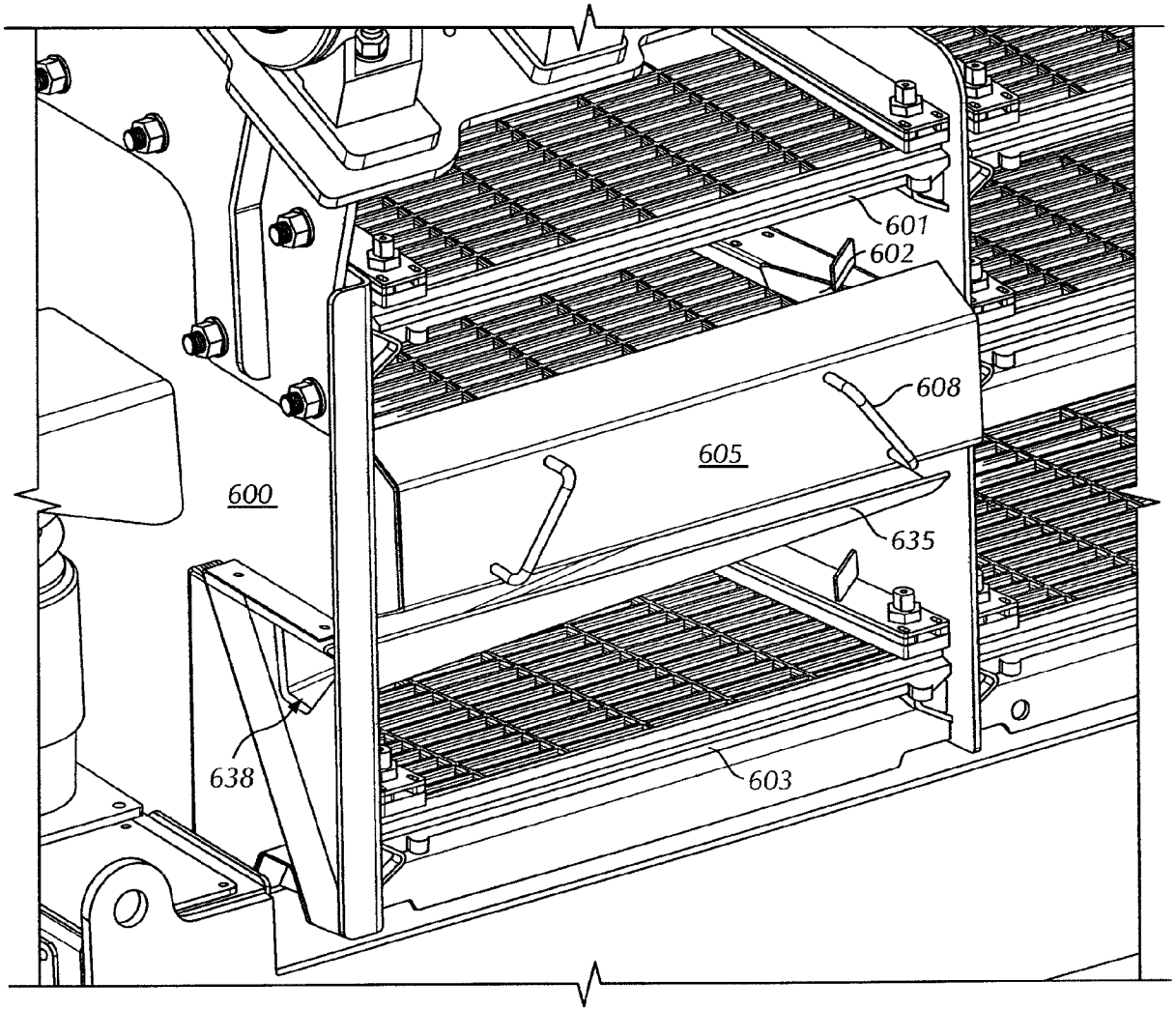
FIG. 6B is an end view of a vibratory separator according to embodiments of the present disclosure.
Figure 6C:
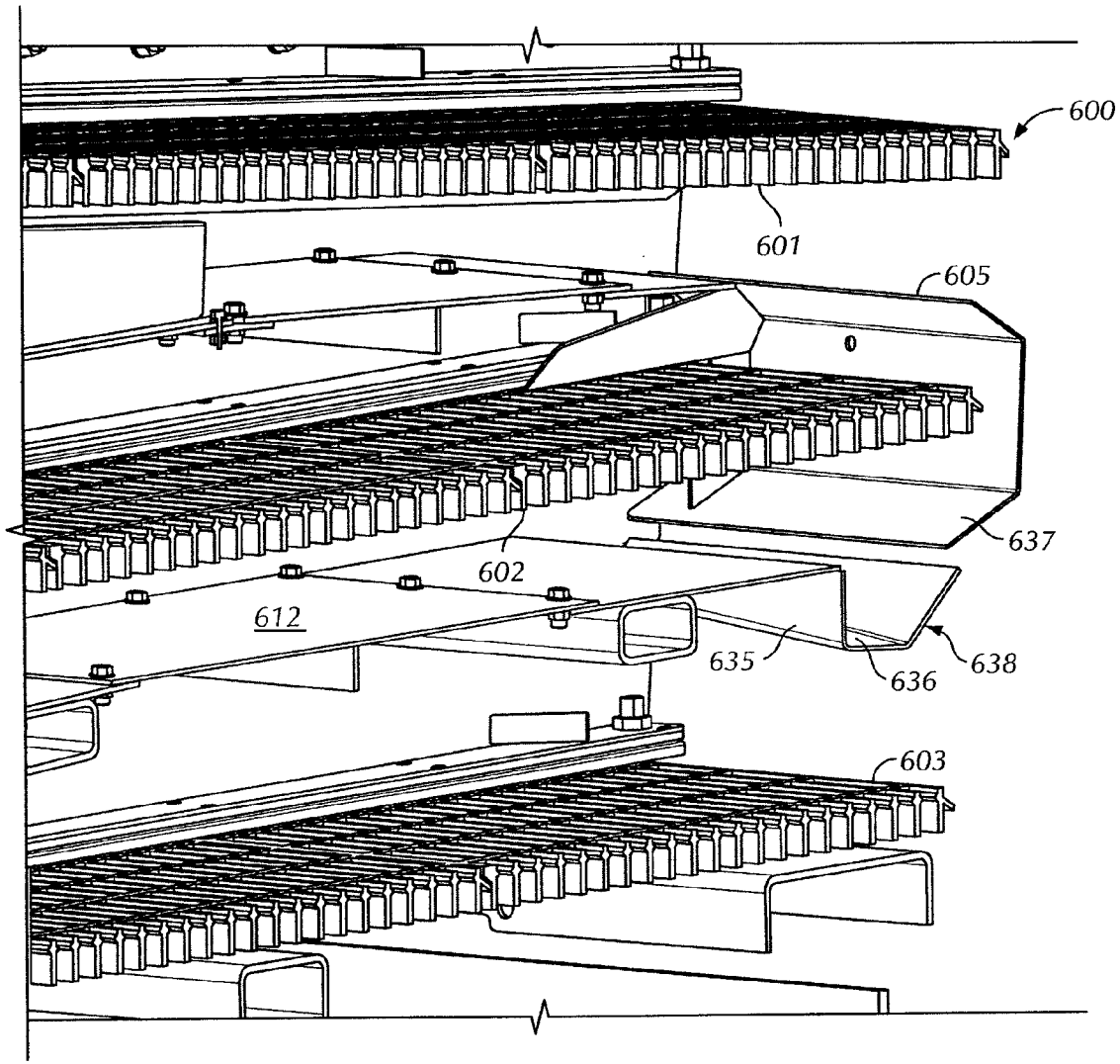
FIG. 6C is a cross-sectional perspective view of a vibratory separator according to embodiments of the present disclosure.
Figure 6D:
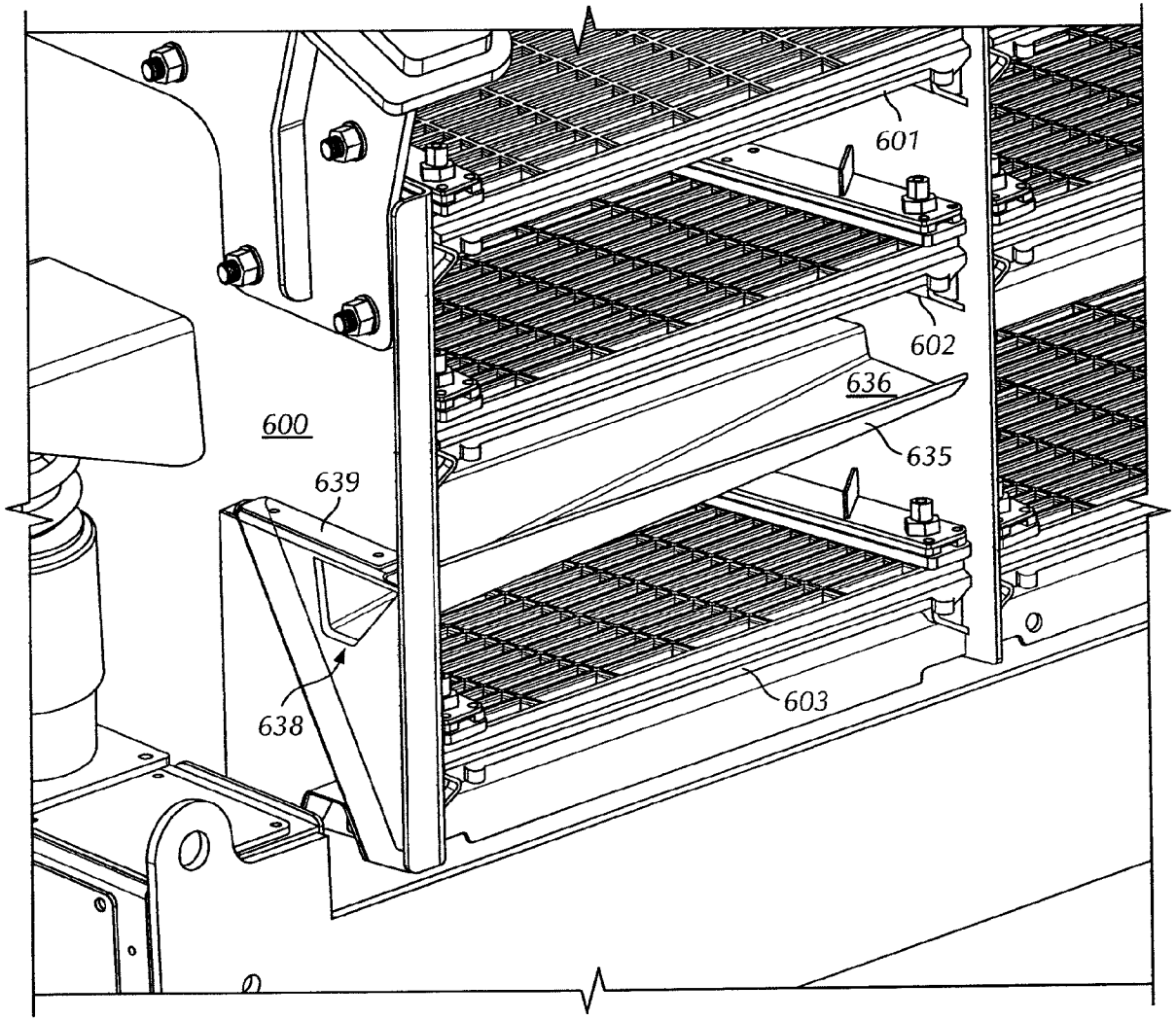
FIG. 6D is a perspective end view of a vibratory separator according to embodiments of the present disclosure.

Referring to FIG. 5, a perspective view of a collection trough 505 according to embodiments of the present disclosure is shown. In this embodiment, collection trough 505 is illustrated as including two engagement surfaces 515, each engagement surface 515 including an extension panel 516. Extension panel 516 includes a radiused end section 534 configured to engage a clamping actuator, as discussed above. Collection troughs 505 formed in accordance with the present disclosure may also include a retaining portion 533 and an angled surface 520. Retaining portion 533 may prevent an overflow of wellbore strengthening materials out of collection trough 505 when the return flow rates are high. Additionally, retaining portion 533 may have a higher profile at a discharge end 535, thereby keeping wellbore strengthening materials in collection trough 505, and directing the wellbore strengthening materials to outlet 507.

In certain embodiments, collection trough 505 may be integrally formed with a vibratory separator. In such embodiments, collection trough 505 may be welded, or otherwise permanently affixed to the vibratory separator. In still other embodiments, a collection trough may include a split design, wherein a lower portion of the collection trough is coupled to the shaker, while a diverter portion is disposed between one or more of the actuators and one or more of the screens of the vibratory separator.

Referring to FIGS. 6A-D, various views of an alternate collection trough according to embodiments of the present disclosure is shown. In this embodiment, collection trough 605 is disposed on vibratory separator 600. Collection trough 605, as illustrated, is removeably coupled to a second deck 602 of vibratory separator 600, which also includes a first deck 601 and a third deck 603. Collection trough 605 includes an inlet 606 configured to receive a flow of wellbore strengthening materials from second deck 602. As the wellbore strengthening materials flow into inlet 606 and through collection trough 605, the materials are discharged through an outlet 607.

In this embodiment, the outlet 607 is configured to direct the materials to a diverter 635. Diverter 635 may include a second trough coupled to vibratory separator 600 providing a discharge path for the wellbore strengthening materials from vibratory separator 600. As illustrated, diverter 635 may be integrally formed with vibratory separator 600, such as being welded to a deck 601, 602, or 603, of vibratory separator 600. However, in alternate embodiments, diverter 635 may be removeably coupled to vibratory separator 600, such that when wellbore strengthening materials are not being collected, diverter 635 may be removed therefrom.

To direct the flow of wellbore strengthening materials through diverter 635, diverter 635 may include an angled lower portion 636, such that the materials flow from an inlet portion 637 of the diverter, down the angled lower portion 636, and through a diverter discharge 638. After exiting diverter discharge 638, the materials may be transferred out of vibratory separator 600 and into the active drilling mud system through a series of conduits, augers, etc.

As illustrated, collection trough 605 and diverter 635 may be installed on vibratory separator 600 at different or separate attachment locations. In the illustrated aspect, collection trough 605 is coupled to second deck 602, while diverter 635 is coupled to second flowback pan 612. In alternate aspects, collection trough 605 may be coupled to first deck 601 or third deck 603, while diverter 635 is coupled to another deck 601, 602, 603, or an alternate flowback pan. In still other aspects, diverter 635 may be coupled to the body of vibratory separator 600 using a retainer 639. Thus, those of ordinary skill in the art will appreciate that collection trough 605 and diverter 635 may be disposed at various locations on vibratory separator so long as the flow of wellbore strengthening materials may flow from collection trough 605 into diverter 635.

Additionally, either or both of collection trough 605 and/or diverter 635 may be removeably coupled to vibratory separator 600. As such, either the collection trough 605 or the diverter 635 may be removed from vibratory separator 600 when wellbore strengthening materials are not being collected. In other aspects, either or both of collection trough 605 and/or diverter 635 may be integrally formed with vibratory separator 600. In such aspects, the one or more of collection trough 605 and diverter 635 may be welded to the body, deck, flowback pan, or other component of vibratory separator 600. In still other aspects, collection trough 605 and/or diverter 635 may be coupled to vibratory separator 600 through pneumatic or mechanical attachment devices. Examples of pneumatic devices include the clamping actuators (FIG. 3, 331) discussed above, while examples of mechanical attachment devices may include bolts, clasps, screws, etc.

Also, as discussed above, collection trough 605 may have specific features facilitating the removal of collection trough 605 from vibratory separator 600, such as handles 608. Thus, in certain embodiments, collection trough 605 may be removed from vibratory separator 600 by sliding collection trough in direction A. As such, collection trough 605 and diverter 635 may form a modular collection system for recovering wellbore strengthening materials from vibratory separator 600.

During operation methods of recovering wellbore strengthening materials may include providing a flow of drilling fluid from a wellbore to a vibratory separator. The flow may be received directly from downhole, or may be processed by other separatory equipment, such as additional vibratory separators to, for example, remove large solids from the drilling fluid. As the drilling fluid flows into the separator, the drilling fluid is separated into a first effluent and a solids portion. The solids portion is discarded from a first deck of the vibratory separator, while the first effluent including wellbore strengthening materials and fine particulate matter flows to a second screen deck of the vibratory separator.

After the first effluent passes through the first screen, wellbore strengthening materials are separated from the first effluent. To separate the wellbore strengthening materials, the drilling fluid having the wellbore strengthening materials entrained therein is passed over a second screen, thereby allowing the fluids and fine particulate matter to flow through the second screen and to a third deck of the vibratory separator. The separated wellbore strengthening materials are then collected in a removable collection trough and directed to an active drilling fluid system. In certain aspects, the wellbore strengthening materials may be passed over an angled portion of the removable collection trough, thereby facilitating the flow of wellbore strengthening materials from the collection trough into the active drilling fluid system.

The second effluent created by passing the residual drilling fluid through the second screen may then be directed to a third screen, whereby a third effluent of residual drilling fluid is separated from fines. The fines may be discharged from the separator and collected for disposal, while the third effluent may be recycled into the active drilling fluid system. One of ordinary skill in the art will appreciate that the trough may receive wellbore strengthening materials from the first, second, or third deck depending on the size of the wellbore strengthening materials being collected or the perforation size of the screens on the respective decks.

When an operator determines that the collection trough is no longer necessary, for example when wellbore strengthening materials are no longer being used, the collection trough may be disengaged from the vibratory separator. By disengaging the collection trough, the vibratory separator may be used in additional separatory operations without collection of any sized media. Because the collection trough is removable, the vibratory separator may find increased utility over existing systems and methods.

Advantageously, embodiments disclosed herein may provide methods of removing wellbore strengthening materials from a return flow of drilling fluids, such that the wellbore strengthening materials may be recycled into the active drilling fluid system. Because wellbore strengthening materials are expensive, by allowing the reuse of the wellbore strengthening materials, the cost of the drilling operation may be decreased.

Also advantageously, the removable aspect of the collection trough may allow for a single vibratory separator to be used in drilling operations where wellbore strengthening materials are used during certain portions of drilling and are not used in other portions of drilling. Because the collection trough is removable, an operator may stop the vibratory separator for a short period of time, remove the collection trough, and then restart the vibratory separator. Additionally, because the collection trough may be secured to the vibratory separator through pressure actuation, the down time it takes to reconfigure the vibratory separator may be substantially reduced over present techniques. Thus, the removable collection trough may decrease rig downtime associated with reconfiguring the operation of vibratory separators in drilling operations recycling wellbore strengthening materials. Additionally, because the collection trough is removable from the vibratory separator, a single collection trough may be shared between multiple drilling operations, thereby further decreasing the cost associated with recycling wellbore strengthening materials.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A system comprising:

a vibratory separator comprising:

a top deck;

a middle deck; and a bottom deck; and a collection trough coupled to at least one of the decks, wherein the collection trough comprises an inlet bounded by a first side, a second side and a back wall, and an angled lower surface traversing downwardly from the first side to the second side, the angled lower surface terminating at an outlet outside the vibratory separator, wherein the collection trough outlet extends outwardly away from at least one of the decks and terminates outside the vibratory separator.

2. The collection system of claim 1, wherein the collection trough is removable.

3. The collection system of claim 1, wherein the inlet is configured to receive wellbore strengthening materials from at least one of the decks; and the angled lower surface is configured to direct the received wellbore strengthening materials out of the vibratory separator.

4. The collection system of claim 3, wherein the outlet further directs the wellbore strengthening materials to an active drilling fluid system.

5. The collection system of claim 3, wherein the collection trough further comprises:

at least two engagement surfaces configured to engage the at least one of the decks of the vibratory separator.

6. The collection system of claim 5, wherein the vibratory separator further comprises:

a pressure actuation device configured to secure the engagement surfaces of the collection trough to at least one of the decks of the vibratory separator.

7. The collection system of claim 1, further comprising:

a first screen disposed on the top deck;

a second screen disposed on the middle deck; and a third screen disposed on the bottom deck.

8. The collection system of claim 7, wherein the first screen comprises perforations having a larger diameter than the second screen.

9. The collection system of claim 8, wherein the second screen comprises perforations having a larger diameter than the third screen.

10. The collection system of claim 1, wherein the collection trough further comprises:

a diverter coupled to the vibratory separator, wherein the diverter directs the wellbore strengthening materials to an active drilling fluid system.

11. A system comprising:

a vibratory separator comprising a deck; and a collection trough comprising:

an inlet disposed between a first side and a second side of the collection trough, the inlet traversing the width of the deck;

an outlet substantially parallel to the inlet, extending outwardly from the deck and terminating outside the vibratory separator proximate the second side;

an angled bottom surface traversing downwardly from the first side to the second side of the collection trough toward the outlet and terminating at the outlet; and an engagement surface having at least one extension panel extending from a front of the collection trough, wherein the engagement surface secures the collection trough to a solids discharge end of a deck of the vibratory separator, wherein the collection trough is configured to receive a flow of wellbore strengthening materials from the vibratory separator, such that the wellbore strengthening materials are removed and discharged from the vibratory separator by the collection trough.

12. The system of claim 11, wherein the at least one extension panel is secured through pressure actuation.

13. The system of claim 11, further comprising:

at least one handle disposed on the collection trough and configured to allow the collection trough to he removed from the vibratory separator.

14. The system of claim 11, wherein the outlet is configured to direct the flow of wellbore strengthening materials from the collection trough to an active drilling fluid system.

15. The system of claim 11, wherein the outlet is located in the second side of the collection trough.

16. The system of claim 11, further comprising a retaining portion configured to prevent an overflow of collected material within the collection trough.

* * * * *